US005668343A

United States Patent [19]

Simon et al.

[11] Patent Number: 5,668,343

[45] Date of Patent: Sep. 16, 1997

[54] GATLING TYPE MULTI-BARREL WEAPON WITH SLIDING CHAMBERS

[75] Inventors: Georges Simon, Saint-Germain-Du-Puy; Emmanuel Mornay, Bourges, both of France

[73] Assignee: CTA International, Versailles, France

[21] Appl. No.: 621,210

[22] Filed: Mar. 22, 1996

[30] Foreign Application Priority Data

Mar. 24, 1995 [FR] France ..... 95 03486

[51] Int. Cl.[6] ..... F41A 9/36

[52] U.S. Cl. ..... 89/12; 89/13.05; 89/155

[58] Field of Search ..... 89/12, 13.05, 33.03, 89/155, 157

[56] References Cited

U.S. PATENT DOCUMENTS

| | | | |
|---|---|---|---|
| 125,563 | 4/1872 | Gatling | 89/12 |
| 199,915 | 2/1878 | Leland | 89/12 |
| 1,424,751 | 8/1922 | Bangerter | 89/126 |
| 2,849,921 | 9/1958 | Otto | 89/12 |
| 2,950,652 | 8/1960 | O'Brien | 89/155 |
| 3,342,105 | 9/1967 | Fagerstrom | 89/12 |
| 3,688,637 | 9/1972 | Tan | 89/12 |
| 3,760,683 | 9/1973 | Seemann | 89/12 |
| 3,834,272 | 9/1974 | Patenaude et al. | 89/12 |
| 4,166,407 | 9/1979 | Ashley et al. | 89/12 |
| 4,216,698 | 8/1980 | Chiabrandy | 89/12 |
| 4,342,253 | 8/1982 | Kirkpatrick et al. | 89/12 |
| 4,735,125 | 4/1988 | Bohler et al. | 89/12 |
| 4,791,851 | 12/1988 | Stoner | 89/156 |
| 5,315,913 | 5/1994 | Rossier et al. | 89/12 |
| 5,370,036 | 12/1994 | Stoner | 89/155 |

*Primary Examiner*—Michael J. Carone
*Assistant Examiner*—Matthew J. Lattig
*Attorney, Agent, or Firm*—Oliff & Berridge

[57] ABSTRACT

A GATLING type multi-barrel weapon includes a revolving assembly with sliding loading and firing chambers that are in axial alignment with the barrels of the weapon. Each chamber is able to move between an open and a closed position following a translational to-and-fro movement in parallel to the rotational axis of the revolving assembly, the two positions being at a distance from one another such as to define a loading space that extends axially for a distance corresponding to the length of a munition. When the chamber is in its open position, supports retain a munition received in the loading space, the supports being formed of two supports respectively provided on the front end face of each chamber and on a ring mounted sliding on the rear part of the barrel. The weapon notably allows plastic-cased telescoped munitions having a polygonal cross section to be fired.

18 Claims, 3 Drawing Sheets

GATLING TYPE MULTI-BARREL WEAPON WITH SLIDING CHAMBERS

BACKGROUND OF THE INVENTION

The present invention relates to a GATLING type multi-barrel weapon with sliding chambers, this small or medium-caliber weapon notably being designed to fire telescoped munitions.

Generally, a GATLING type multi-barrel weapon comprises a revolving body in which a loading area, a firing area and an ejection area are arranged, areas which are axially aligned along the rotational axis of the revolving body. The weapon barrels are integral with the revolving body and with the latter form a revolving body supported in rotation by the weapon frame.

In the firing area, the revolving body supports several chambers, generally in equal number to the weapon barrels, and each chamber moves radially with respect to its associated barrel.

A weapon of this type notably has two drawbacks, as follows:

- a relatively large diameter due to the radial movement of the chambers, and
- a revolving body which is at least three times longer than a munition because of the alignment of the loading, firing and ejection areas.

To overcome these drawbacks, a GATLING type multi-barrel weapon, notably described in previous document (U.S. Pat. No. 5,315,913) where the chambers are slidably mounted along the rotational axis of the revolving assembly, which both enables the reduction of the diameter of the weapon and the length of the revolving body. Each chamber is formed of a tubular element which is axially aligned with an associated barrel of the weapon and is able to move between two opening and closing positions according to a translational to-and-fro movement. This translational movement is such that:

- when the chamber is in its open position, the front end face of the chamber is located at a distance from the rear end face of the associated barrel to enable a munition to be loaded between the chamber and the associated barrel, the munition being held in axial alignment with the chamber and the associated barrel by support means formed of two supports on which the two ends of the munition respectively come to bear, one support being provided on the front end face of the support and guiding element of each chamber, whereas the other support is provided on the rear face of the barrel, and
- when the chamber is in its closed position, the chamber encompasses the munition and its front end face comes into contact with the rear end face of the associate barrel.

Each chamber is mounted free to revolve around an elongated cylindrical element which is axially aligned with a weapon barrel, the front end face of this support and guiding element also being located at a distance from the rear end face of the barrel, so as to be able to load a munition when the chamber is in its open position.

However, in this document, the telescoped munitions envisaged are cylindrical in shape but have, at each end, a bevel so that the two supports which hold the munition must have a matching profile.

The use of such a weapon is thus restricted to firing telescoped munitions of a particular shape. In concrete terms, such a weapon can only fire metal-cased telescoped munitions. In fact, when the chamber is in its closed position, the support which is provided on the rear end face of the barrel leaves a space above it into which a plastic-cased telescoped munition could yield during firing.

In conclusion, such a weapon can only fire cylindrical metal-cased telescoped munitions with bevelled ends.

SUMMARY OF THE INVENTION

The aim of the present invention is to overcome these drawbacks whilst providing other advantages.

To this end, the invention relates to a GATLING type multi-barrel weapon with sliding chambers, notably designed to fire telescoped munitions, this weapon comprising a revolving assembly formed of a body housed in a frame, extended by the barrels of the weapon and supporting in a sliding manner the loading and firing chambers formed of tubular elements, each chamber being axially aligned with one of the barrels of the weapon and able to move between two open and closed positions following a translational to-and-fro movement parallel to the rotational axis of the revolving assembly and such that:

- when the chamber is in its open position, the front end face of the chamber is located at a distance from the rear end face of the associated barrel to enable a munition to be loaded between the chamber and the associated barrel, the munition being held in axial alignment with the chamber and the associated barrel by support means formed of two supports on which the two ends of the munition bear respectively, and
- when the chamber is in its closed position, the chamber entirely encompasses the munition and its front end face is in contact with the rear end face of the associated barrel,
- a weapon which is characterised, in that the two supports forming the support means are provided respectively on the front end face of the chamber and on a sliding ring located to the rear part of the barrel, and in that each chamber is slidably mounted on a support and guiding means whilst being fixed in rotation with respect to the latter, such that the weapon can fire telescoped munitions of any shape, notably those having a plastic case, and whose cross section is roughly the same from one end to the other of the munition.

Generally, the ring which supports one of the retaining supports for the munition when the chamber is in its open position is slidably mounted on the rear end of the barrel and has a translational to-and-fro movement in synchronization with that of the associated chamber.

According to one embodiment of the invention, the translational movement of the ring is obtained from a helicoidal-shaped cam projecting from the inner wall of the frame and encompassing the revolving body of the weapon, and from a cam follower supported by the ring which presses on this cam.

Thus, the ring is able to move between two rear and front positions, such that:

- when the ring is in its rear position, its retaining support projects from the rear end of the associated barrel, and
- when the ring is in its front position, the retaining support is disengaged from the rear end face of the associated barrel.

According to another characteristic of the invention, each chamber is fixed in rotation with respect to its support and guiding means, with unclear two longitudinal diametrically opposed ribs on its outer periphery which are respectively housed in two rectilinear grooves machined in the revolving body of the weapon.

Generally, the translational to-and-fro movement of the chambers is obtained by a helicoidal-shaped cam projecting from the inner wall of the frame which encompasses the revolving body of the weapon, and by a radial cam follower carried by the chamber and bearing on this cam.

According to a first advantage of the invention, the weapon can fire telescoped munitions of any shape, notably those having a square cross section, and a non-metallic case.

BRIEF DESCRIPTION OF THE DRAWINGS

Other advantages, characteristics and particulars of the invention will become apparent from the explanatory description which follows made in reference to the appended drawings, given merely by way of illustration, in which.

DESCRIPTION OF PREFERRED EMBODIMENT

Figure 1:
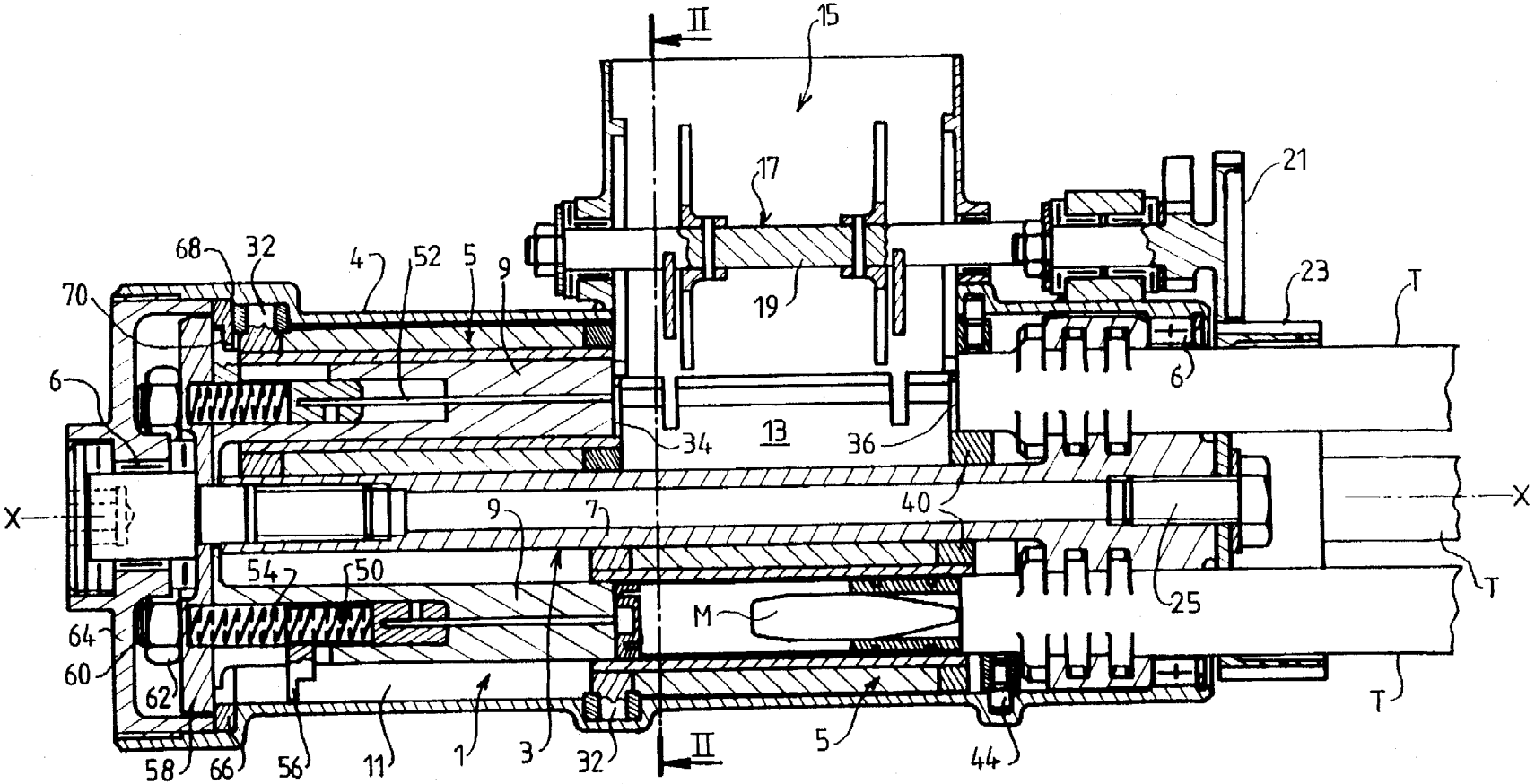
FIG. 1 is a partial longitudinal section view of the weapon according to the invention, with an upper half-section and a lower half-section to show how the weapon functions.

The GATLING type multi-barrel weapon shown in FIG. 1 comprises a revolving assembly 1 formed of a body 3 housed in a frame 4 which is fixed in rotation, extended by the barrels T of the weapon and which supports the loading and firing chambers 5, which are equal in number to the barrels T, four for example. This revolving assembly 1 is mounted revolving along the longitudinal axis X—X of the weapon by means of bearings 6.

Generally, the terms front and rear used hereafter in the description are defined with respect to the line of fire of the weapon.

The revolving body 3 comprises a central hub 7 whose axis corresponds to the rotational axis X—X of the revolving assembly 1. At its rear part, the hub 7 comprises support and guiding elements 9 for the chambers 5. These elements 9 are cylindrical and elongated in shape, are respectively aligned with the barrels T of the weapon and are evenly distributed around the revolving body 3. Each support and guiding element 9 marks out between its outer peripheral surface and the inner peripheral surface of the frame 4 a ring-shaped space 11 in which a chamber 5 is positioned when said chamber is in its rear or open position, as will be explained later.

An empty loading space 13 for a munition M is provided between the front end face of each support and guiding element 9 and the rear end face of each associated barrel T. (Above this loading space 13,) the frame 4 is provided with a lateral opening around which a device 15 is mounted to feed the weapon in ammunition. Each loading space 13 extends axially for a length corresponding to that of the munitions M.

The feed device 15 notably comprises a star-shaped wheel 17 supported in rotation by a shaft 19 parallel to the axis X—X of the weapon. Towards one end, the shaft 19 supports a wheel 21 to drive the star-wheel 17 in rotation. The drive wheel 21 meshes with an annular gear 23 centred on the barrels T and held immobile by a screw 25 engaged in the front end face of the hub 7. The annular gear 23 is located slightly beyond the front end face of the revolving body 3 of the weapon.

Each loading and firing chamber 5 is able to make a translational to-and-fro movement in parallel to the axis X—X of the weapon.

More precisely, each chamber 5 is formed of a tubular element open at both ends and slidably mounted on an associated support and guiding element 9 between two rear or open and front or closed positions.

In its rear or open position, the chamber 5 is positioned in the ring-shaped space 11 defined around the support and guiding element 9 so as to leave the loading space 13, provided between the support and guiding element 9 and the associated barrel T, totally free.

In its front or closed position, the chamber 5 is positioned in the loading space 13 so as to encompass the munition M previously loaded in said space 13, and its front end is, in this position, in contact with the rear end face of the associated barrel T.

Each chamber 5 is fixed in rotation with respect to its support and guiding element 9. To this end, as may be seen in FIG. 2, each chamber 5 is fitted with two longitudinal ribs 27 on its outer peripheral surface, ribs which are diametrically opposed and designed to engage respectively in two matching grooves 29 made in the revolving body 3.

Figure 2:
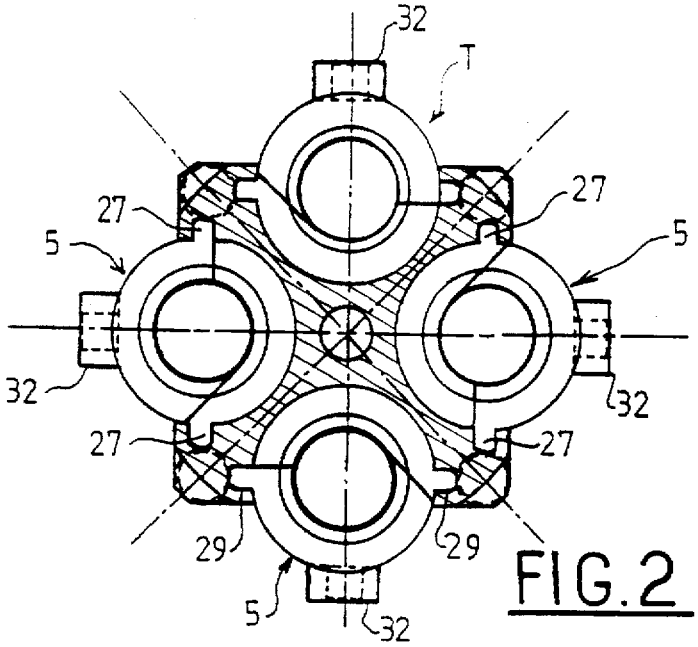
FIG. 2 is a section view along line II—II in FIG. 1.
Figure 3:
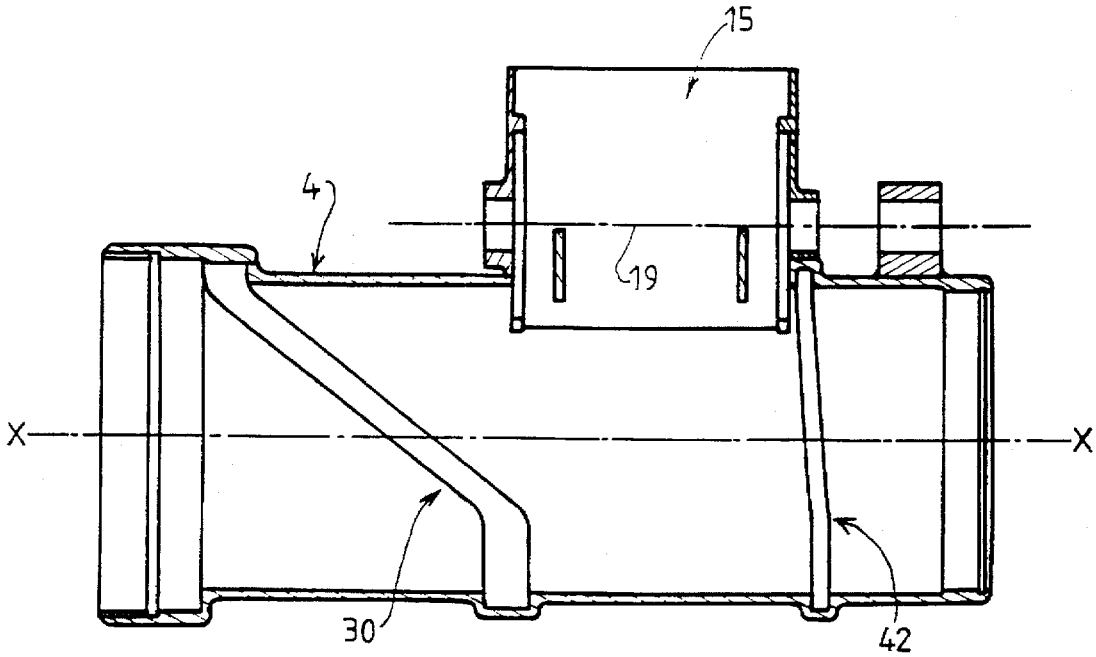
FIG. 3 is a schematic section view to show the cam grooves provided in the weapon frame.

With reference to FIGS. 2 and 3, a helicoidal-shaped cam 30 is provided on the cylindrical inner wall of the frame 4 of the weapon upon which cam followers 32, one cam follower 32 for each chamber, come to bear. The cam follower 32 is supported in rotation by each chamber 5, the axis of the cam follower being perpendicular to the longitudinal axis of the chamber. The cam 30 thus enables all the chambers 5 to be moved simultaneously and in synchronization.

Means to support and retain a munition M in axial alignment with a chamber 5 and its associated barrel T are also provided in each loading space 13, when said chamber 5 is in its rear or open position.

Figure 4:
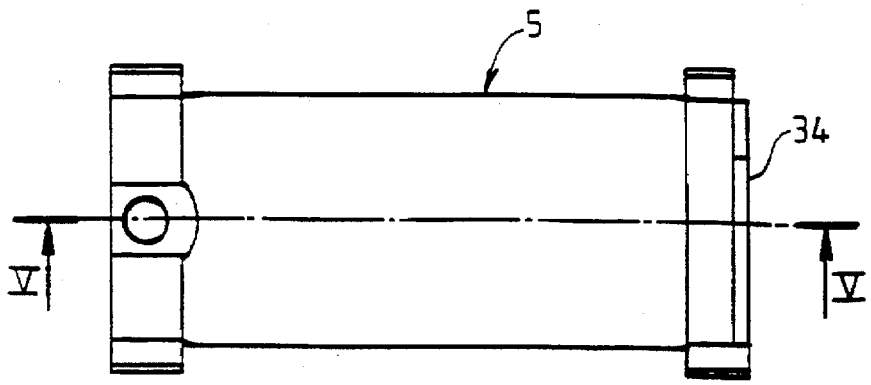
FIG. 4 is an external view of a loading and firing chamber.
Figure 6:
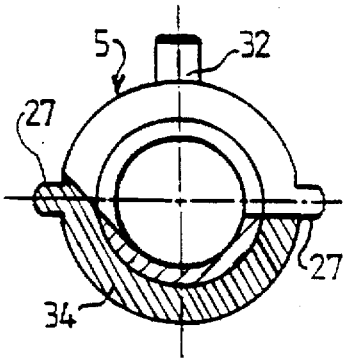
FIG. 6 is a section view along line VI—VI in FIG. 5.
Figure 5:
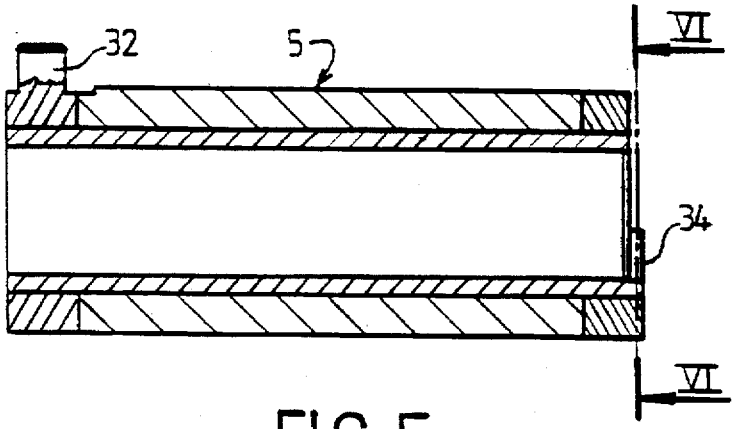
FIG. 5 is a section view along line V—V in FIG. 4.
Figure 7:
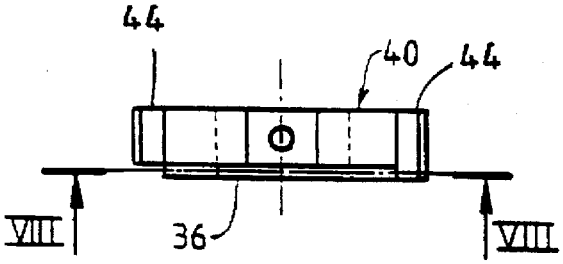
FIG. 7 is an external view of a retaining ring for a munition.
Figure 8:
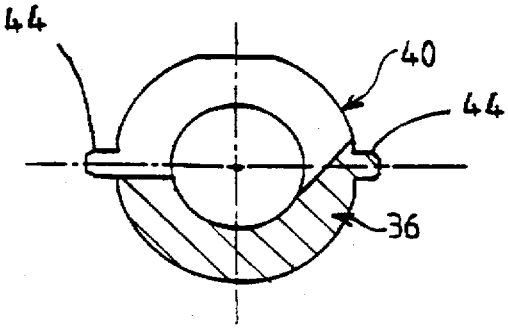
FIG. 8 is a section view along line VIII—VIII in FIG. 7.

These support and guiding means are formed of two semi-circular supports 34 and 36. One support 34 (FIGS. 4 to 6) is located at the front end face of each chamber 5, whereas one support 36 (FIGS. 7 and 8) is located on a face of a ring 40 mounted sliding on the rear end part of the associated barrel T.

Each ring 40 makes a translational to-and-fro movement between a rear position and a front position. In its rear position, each ring 40 is located at the rear end of the barrel T, such that its support 36 projects inside the loading space 13. In its front position, the ring 40 has moved along the barrel T so as to move the support 36 beyond the loading space 13 (FIG. 1).

A helicoidal-shaped cam 42 (FIG. 3) projects from the inner peripheral wall of the frame 4 upon which cam followers 44 (FIG. 1) respectively supported by the rings 40 come in contact. This cam 42 enables all the rings 40 to be moved in synchronization according to the position of the associated chambers 5.

A percussion device 50 is housed inside each support and guiding element 9 (FIG. 1). Each percussion device 50 comprises a firing pin 52 armed by a spring 54, and a radial operating heel part 56. The springs 54 press on a washer 58 brought around the hub 7 and which presses on the rear end face of the support and guiding elements 9.

The washer 58 is engaged on threaded trunnions 60 carried by the revolving body 3 of the weapon and immobilized by nuts 62 screwed onto the trunnions 60.

A cover 64 is screwed to the rear part of the revolving body 3 which immobilizes a ring 66 against a shoulder 68 of the body 3. This ring 66 is located in front of the washer 58 and is fitted with a radial inner collar 70 designed to work in conjunction with the operating heel part 56 of the firing pins 52.

The revolving assembly 1 is rotated by means of a motor element (not shown) which drives an output gear which meshes the annular gear 23, this rotational movement also being transmitted to the ammunition feed device 15 by drive wheel 21.

An operating cycle of the weapon will now be described which corresponds to a full revolution of the revolving assembly 1 and during which each barrel T fires a munition.

During the operating cycle of the weapon, each chamber 5 successively moves through four sectors, respectively:

a loading sector, a closing sector a firing sector, and an opening sector which precedes the loading sector.

When a chamber 5 moves through the loading sector, the chamber 5 is retained in its rear or open position, i.e. it occupies the ring-shaped space 11 arranged around its support and guiding element 9. The chamber 5 is thus kept at a distance from the associated barrel T in order to free the loading space 13 and enable the feed device 15 to load a munition M in this space 13 using the star-wheel 17 such that its two ends bear respectively on supports 34 and 36 which thus retain the munition in axial alignment with the chamber 5 and the associated barrel T. The ring 40 located at the rear end of the associated barrel T is, in this case, in its rear position so that the support 36 projects into the loading space 13. An extraction device (not shown) removes the case of the munition fired previously from the barrel T before a new munition is accommodated.

The chamber 5 then moves through the closing sector during which the chamber 5 gradually moves from its rear position to its front position. During this movement, the chamber 5 gradually encompasses the munition M located in the loading space 13. The ring 40 also moves gradually and in synchronization from its rear position to its front position in order to free the support 36, so as not to leave a gap or play between the front end face of the chamber 5 and the rear end face of the barrel T which are going to come into contact with one another.

When the chamber 5 reaches its closed position, corresponding to the beginning of the firing sector, the propellant charge of the munition M is initiated by the percussion device 50 associated with the chamber 5. More precisely, the operating heel part 56 of the firing pin 52 is released by the collar 70 on the ring 66 to enable the firing pin 52 to strike the munition M igniter following the release of the arming spring 54.

Finally, the chamber 5 moves through the opening sector during which it moves translationally towards its rear position in order to gradually free the loading space 13. During this backward movement, the chamber 5 comes into contact with the operating heel part 56 of the firing pin 52 and pushes said firing pin to the rear causing the compression of the arming spring 54. When the chamber 5 has reached its rear position, the heel 56 of the firing pin 52 is retained by the collar 70 on the ring 66. In parallel, the ring 40 is also moved to the rear so that its support 36 projects once again into the loading space 13, and a new operating cycle can begin.

Generally, the telescoped munitions M fired from the weapon can have a circular or polygonal cross section, and the cross section of the housing marked out by each chamber 5 is of a matching shape.

Generally, the frame 4 of the weapon is connected to a mounting (not shown) by a recoil mechanism, such that the frame 4 is immobilized in rotation whilst being able to move axially under the combined action of the firing forces and the recoil mechanism.

We claim:

1. An improvement for a GATLING type multi-barrel weapon, notably designed to fire telescoped munitions, the weapon including a revolving assembly formed of a body housed in a frame extended by the barrels of the weapon and supporting in a slideable manner sliding chambers formed of tubular elements, each of the sliding chambers being axially aligned with one of the barrels of the weapon and being able to move between an opened and a closed position following a translational movement parallel to a rotational axis of the revolving assembly, the improvement comprising:

two munition retaining supports that, when a sliding chamber is in its open position such that a front end face of the sliding chamber is located at a distance from a rear end face of the associated barrel to enable a munition to be loaded between the sliding and the associated barrel, hold the munition in axial alignment with the sliding chamber and the associated barrel, and wherein each sliding chamber is slidably mounted on a sliding chamber support and guiding member and is rotationally fixed with respect to the support and guiding member.

2. The improvement for a GATLING type multi-barrel weapon of claim 1, wherein one of the two munition retaining supports is provided at a front end face of the sliding chamber and the other of the two munition retaining supports is provided on a sliding ring located at a rear end part of the associated barrel, respectively.

3. The improvement for a GATLING type multi-barrel weapon of claim 2, wherein each sliding chamber comprises, on its outer periphery, two longitudinal diametrically opposed ribs that are respectively housed in two rectilinear grooves machined in the revolving body of the weapon, such that each sliding chamber is fixed in rotation with respect to its support and guiding member.

4. The improvement for a GATLING type multi-barrel weapon of claim 2, wherein the ring is slidably mounted on the rear end part of the associated barrel and has a translational movement in synchronization with that of the associated sliding chamber.

5. The improvement for a GATLING type multi-barrel weapon of claim 4, wherein the translational movement of the sliding chamber and the ring are synchronized and are obtained during rotation of the revolving body by means of two cams provided projecting from an inner wall of the frame of the weapon.

6. The improvement for a GATLING type multi-barrel weapon of claim 5, wherein each sliding chamber supports a cam follower and each ring supports a cam follower, the cam followers coming to bear on the associated cams.

7. An improvement for a GATLING type multi-barrel weapon, notably designed to fire telescoped munitions, the weapon including a revolving assembly formed of a body housed in a frame extended by the barrels of the weapon and supporting in a slideable manner sliding chambers formed of tubular elements, each of the sliding chambers being axially aligned with one of the barrels of the weapon and being able to move between an open and a closed position following a translational movement parallel to a rotational axis of the revolving assembly, the improvement comprising:

munition retaining support means for, when a sliding chamber is in its open position such that a front end face of the sliding chamber is located at a distance from a rear and the face of the associated barrel to enable a munition to be loaded between the sliding chamber and the associated barrel, holding the munition in axial alignment with the sliding chamber and the associated barrel; and support and guiding means for supporting and guiding each of the sliding chambers, each of said sliding chambers being mounted thereon and being rotationally fixed with respect to the support and guiding means.

8. The improvement for a GATLING type multi-barrel weapon of claim 7, wherein the munition retaining support means comprises two munition retaining supports, one of the two munition retaining supports being provided at a front end face of the sliding chamber and the other of the two munition retaining supports being provided on a sliding ring located at a rear end part of the associated barrel, respectively.

9. The improvement for a GATLING type multi-barrel weapon of claim 8, wherein each sliding chamber comprises, on its outer periphery, two longitudinal diametrically opposed ribs that are respectively housed in two rectilinear grooves machined in the revolving body of the weapon, such that each sliding chamber is fixed in rotation with respect to its support and guiding member.

10. The improvement for a GATLING type multi-barrel weapon of claim 8, wherein the ring is slidably mounted on the rear end part of the barrel and has a translational movement in synchronization with that of the associated sliding chamber.

11. The improvement for a GATLING type multi-barrel weapon of claim 10, wherein the translational movement of the sliding chamber and the ring are synchronized and are obtained during rotation of the revolving body by means of two cams provided projecting from an inner wall of the frame of the weapon.

12. The improvement for a GATLING type multi-barrel weapon of claim 11, wherein each sliding chamber supports a cam follower and each ring supports a cam follower, the cam followers coming to bear on the associated cams.

13. A method for supporting munitions and guiding sliding chambers in a GATLING type multi-barrel weapon, notably designed to fire telescoped munitions, the weapon including a revolving assembly formed of a body housed in a frame extended by the barrels of the weapon and supporting in a slideable manner sliding chambers formed of tubular elements, each of the sliding chambers being axially aligned with one of the barrels of the weapon, and being able to move between an open and a closed position following a translational movement parallel to a rotational axis of the revolving assembly, the method comprising:

providing two munition retaining supports for, when a sliding chamber is in its open position such that a front end face of the sliding chamber is located at a distance from the rear end face of the associated barrel to enable a munition to be loaded between the sliding chamber and the associated barrel, holding the munition in axial alignment with the sliding chamber and the associated barrel; and providing a support and guiding member for supporting and guiding each of the sliding chambers, each of the sliding chambers being mounted thereon and being rotationally fixed with respect to the support and guiding means.

14. The method for a GATLING type multi-barrel weapon of claim 13, further comprising the step of providing each sliding chamber, on its outer periphery, with two longitudinal diametrically opposed ribs that are respectively housed in two rectilinear grooves machined in the revolving body of the weapon, such that each sliding chamber is fixed in rotation with respect to its support and guiding member.

15. The method for a GATLING type multi-barrel weapon of claim 13, wherein the step of providing two munition retaining supports further comprises providing one of the two munition retaining supports at a front end face of the sliding chamber and providing the other of the two munition retaining supports on a sliding ring located at a rear end part of the associated barrel, respectively.

16. The method for a GATLING type multi-barrel weapon of claim 15, wherein the ring is slidably mounted on the rear end part of the barrel and has a translational movement in synchronization with that of the associated sliding chamber.

17. The method for a GATLING type multi-barrel weapon of claim 15, further comprising the step of synchronizing the translational movement of the sliding chamber and the ring obtained during rotation of the revolving body by means of two cams provided projecting from an inner wall of the frame of the weapon.

18. The method for a GATLING type multi-barrel weapon of claim 17, further comprising the step of providing each sliding chamber with a cam follower and each ring with a cam follower, the cam followers coming to bear on the associated cams.

* * * * *